US009145654B2

(12) United States Patent
Berry et al.

(10) Patent No.: US 9,145,654 B2
(45) Date of Patent: Sep. 29, 2015

(54) METHOD AND APPARATUS FOR DRIVING A PILE INTO A SUBSTRATE

(75) Inventors: Alastair Berry, Blandford Forum (GB); Melchior Klopper, Wareham (GB); David Howell Gunter, Poole (GB)

(73) Assignee: IHC Sea Steel Limited, Dorset (GB)

( * ) Notice: Subject to any disclaimer, the term of this patent is extended or adjusted under 35 U.S.C. 154(b) by 0 days.

(21) Appl. No.: 14/111,146

(22) PCT Filed: Mar. 29, 2012

(86) PCT No.: PCT/GB2012/050708

§ 371 (c)(1), (2), (4) Date: Nov. 11, 2013

(87) PCT Pub. No.: WO2012/143697

PCT Pub. Date: Oct. 26, 2012

(65) Prior Publication Data

US 2014/0056649 A1 Feb. 27, 2014

(30) Foreign Application Priority Data

Apr. 21, 2011 (GB) ..... 1106783.2

(51) Int. Cl.
*E02D 7/00* (2006.01)
*E02D 13/04* (2006.01)
*E02D 7/02* (2006.01)

(52) U.S. Cl.
CPC . *E02D 13/04* (2013.01); *E02D 7/02* (2013.01)

(58) Field of Classification Search
USPC ..... 405/227, 228, 232, 224, 244; 166/85.5
See application file for complete search history.

(56) References Cited

FOREIGN PATENT DOCUMENTS

| | | | |
|---|---|---|---|
| GB | 2473683 | A | 3/2011 |
| WO | WO99/11872 | A1 | 3/1999 |
| WO | WO01/92645 | A2 | 12/2001 |
| WO | WO03/074795 | A1 | 9/2003 |
| WO | WO2007/066078 | A1 | 6/2007 |
| WO | WO2009/024739 | A2 | 2/2009 |
| WO | WO2011/083324 | A1 | 7/2011 |

OTHER PUBLICATIONS

International Search Report and Written Opinion of PCT/GB2012/050708 mailed on Aug. 28, 2012, 8 pages.

*Primary Examiner* — Sean Andrish
(74) *Attorney, Agent, or Firm* — Kilpatrick Townsend & Stockton LLP

(57) ABSTRACT

A pile guide (10) for supporting a pile as it is driven into a substrate (20) comprises a base frame (12) having a substrate-engaging surface (14) and a pile guide member (16) mounted on the base frame via a support member (18), the pile guide member being configured to guide a pile in a predetermined direction therethrough as it is driven into a substrate. The support member (18) comprises first and second parts (30,32) which are pivotally coupled together to permit pivotal movement of the pile guide member (16) relative to the base frame about a first axis of rotation (AA). The support member (18) further comprises third and fourth parts (34,36) which are pivotally coupled together to permit pivotal movement of the pile guide member (16) relative to the base frame (12) about a second axis of rotation (BB), enabling pivotal movement of the pile guide member (16) relative to the base frame (12) with two degrees of rotational freedom.

17 Claims, 4 Drawing Sheets

METHOD AND APPARATUS FOR DRIVING A PILE INTO A SUBSTRATE

TECHNICAL FIELD

The present invention relates to a method and apparatus for driving a pile into a substrate, particularly but not exclusively an uneven or undulating underwater substrate with localised variations in level.

BACKGROUND ART

It is known to provide pile guides for underwater piling, see for example, IHC Sea Steel Limited's range of pile guides as described in WO99/11872 (Fast Frame pile guide), WO01/92645 (Finned Frame/follower pile guide) and WO03/074795 (Orientation Control pile guide). Another IHC Sea Steel Limited pile guide, as described in WO2009/024739, was specifically devised to allow for pile driving into an inclined substrate, such as the inclined side of a seabed canyon. The pile guide comprises a pile guide member which is pivotally mounted on a base frame to enable the pile guide member to pivot around an axis of rotation relative to the base frame. With such an arrangement, the orientation of the pile guide member may be adjusted to guide piles in a vertical orientation when the base frame rests on an inclined substrate with the axis of rotation horizontal (i.e. aligned transversely to the incline direction). However, such pile guides are not ideally suited for driving a pile into an uneven or undulating underwater substrate with localised variations in level. This is because such an underwater substrate will have a tendency to support the pile guide at different angles to the horizontal in different locations, which would result in piles being driven into the substrate in different, non-vertical orientations.

Yet another IHC Sea Steel Limited pile guide, as described in PCT/GB2011/050004, was devised to allow for pile driving into an uneven or undulating underwater substrate with localised variations in level. The pile guide comprises a pile guide member mounted on a base frame via a plurality of support members of variable length, with length adjustment of each of the plurality of support members determining the orientation of the pile guide member relative to the base frame. However, with such an arrangement, the variable-length support members must be strengthened or protected to withstand lateral loads experienced by the pile guide during use. The present invention has been devised with this issue in mind.

DISCLOSURE OF INVENTION

In accordance with a first aspect of the present invention, there is provided a pile guide for supporting a pile as it is driven into a substrate, comprising: a base frame having a substrate-engaging surface; and a pile guide member mounted on the base frame via a support frame or member, the pile guide member being configured to guide a pile in a predetermined direction therethrough as it is driven into a substrate, the support member comprising first and second parts which are pivotally coupled together to provide pivotal movement of the pile guide member relative to the base frame about a first axis of rotation, characterised in that the support member further comprises third and fourth parts which are pivotally coupled together to provide pivotal movement of the pile guide member relative to the base frame about a second axis of rotation, enabling the predetermined direction to be varied relative to the substrate-engaging surface of the base frame with two degrees of rotational freedom.

With such an arrangement, the orientation of the predetermined direction of the pile guide member relative to the base frame may be altered to accommodate an uneven or inclined substrate which causes the base frame to rest in a non-horizontal plane. Thus, by pivoting the pile guide member relative to the base frame, it may be possible to align vertically the predetermined direction of the pile guide member when the base frame is resting on an inclined substrate.

The first and second axes of rotation may extend in a common plane, which may be spaced from the substrate-engaging surface of the base frame and which, if the latter is planar, may lie parallel thereto. The first and second axes of rotation may lie perpendicular to one another. One of the first and second parts and one of the third and fourth parts may be rigidly coupled together, for example by a continuous member extending around the pile guide member. The continuous member may be annular. One of the first and second parts may be disposed on an outer periphery of the continuous member, and one of the third and fourth parts may be disposed on an inner periphery of the continuous member. The first and second parts and/or the third and fourth parts may comprise a spindle and a corresponding socket in which the spindle is rotatably mounted.

The support member may be configured to support opposing sides of the pile guide member along at least one of the first and second axes of rotation. Thus, the first and second parts may be one of a pair of such components, spaced apart along the first axis of rotation, and arranged on opposite sides of the pile guide member.

The first part may comprise a post-like support, rigidly attached to the base frame and extending away from the substrate engaging surface. If the first and second parts are one of a pair of such components, and each first part comprises a post-like support, the first axis of rotation will extend between the post-like supports.

The base frame may have an aperture through which a pile may pass when driven in the predetermined direction through the pile guide member. The aperture may be centrally located in the base frame, and may be substantially surrounded by the substrate-engaging surface of the base frame. The pile guide member may depend from the support member. In other words, the support member may engage the pile guide member such that the centre of mass of the pile guide member is below the support member. In fact, the support member may engage an upper portion of the pile guide member, immediately below a flared opening configured to funnel a pile into the pile guide member. In this way, the pile guide member may be biased into adopting a vertical orientation, even when the substrate-engaging surface of the base frame is resting on an inclined (non-horizontal) substrate.

The pile guide may further comprise at least one mechanism for controlling pivotal movement of the pile guide member relative to the base frame about at least one of the first and second axes of rotation. The or each mechanism may be mounted on the base frame and may be coupled to the pile guide member. For example, the or each mechanism may be coupled to a lower portion of the pile guide member, below the support member. The or each mechanism may act as a releasable locking device for use in preventing pivotal movement of the pile guide member relative to the base frame (e.g. to maintain an existing orientation therebetween). When the locking device is released, the pile guide member may move into a particular orientation relative to the base frame. Once the particular orientation has been adopted, the locking device may be (re-)applied to maintain it.

The or each mechanism may comprise a variable length strut. The variable length strut may be pivotally coupled at one end to the base frame, and may be pivotally coupled at its other end to the pile guide member. The variable length strut may be configured to vary its length passively (i.e. in response to a force applied to it by the pile guide member) or actively (i.e. by applying a force to move the pile guide member). In one arrangement, a plurality of mechanisms for controlling pivotal movement of the pile guide member relative to the base frame is provided. For example, there may be at least two, preferably three such mechanisms. With such an arrangement, the plurality of mechanisms may be configured to operate in sympathy with one another when the pile guide member pivots relative to the base frame. The plurality of mechanisms may be circumferentially spaced evenly around the pile guide member. For example, if there are three mechanisms, the mechanisms may be angularly spaced by 120° to give equal circumferential spacing.

The pile guide member may comprise a simple hollow cylinder, or may be as disclosed in: WO01/92645 for use with piles with stabilising fins; WO03/074795 for use with piles with orientation control tabs; or WO2007/066078 for use with piles with profiles which interact with corresponding profiles in the pile guide member to resist bursting pressures in the latter. The entire contents of WO01/92645, WO03/074795 and WO2007/066078 are incorporated herein by reference.

In accordance with a second aspect of the present invention, there is provided a method of driving a pile into a non-level substrate, comprising: providing a pile guide according to the first aspect of the present invention; positioning the pile guide with the substrate-engaging surface of the base frame resting on the non-level substrate; and tilting the pile guide member relative to the base frame until the predetermined direction of the pile guide member is aligned in a predetermined orientation (e.g. vertical).

The pile guide may have any of the features of embodiments of the first aspect of the invention.

The pile guide member may be tilted relative to the base frame when the pile guide is in situ (i.e. positioned with the substrate-engaging surface of the base frame resting on the non-level substrate), even when the non-level substrate is underwater. Tilting of the pile guide member may be controlled automatically (e.g. with the aid of a level detector and control circuitry for controlling the at least one mechanism for pivoting the pile guide member relative to the base frame in response to output from the level detector). In another embodiment, tilting of the pile guide member may be carried out remotely, with external means such as an ROV (remotely operated vehicle) providing feedback on orientation of the support frame relative to the base frame. In yet another embodiment, if the centre of mass of the pile guide member is below the first and second axes of rotation, tilting of the pile guide member may be achieved by allowing it to pivot freely and move under the action of gravity.

BRIEF DESCRIPTION OF DRAWINGS

An embodiment of the invention will now be described, by way of example, and with reference to the accompanying figures, in which.

DETAILED DESCRIPTION OF SPECIFIC EMBODIMENTS

Figure 1:
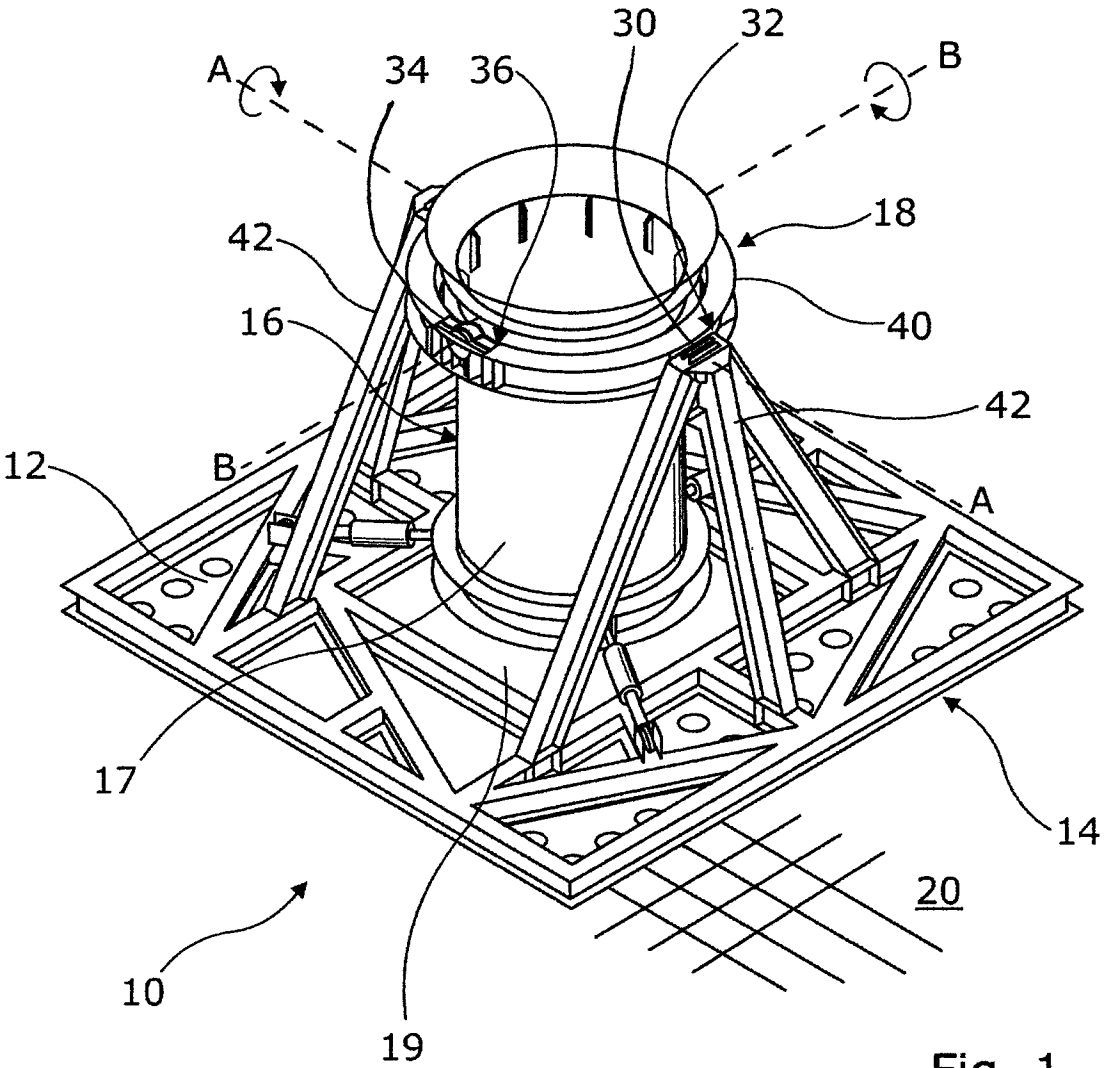
FIG. 1 is a perspective view of a pile guide embodying the present invention.
Figure 2:
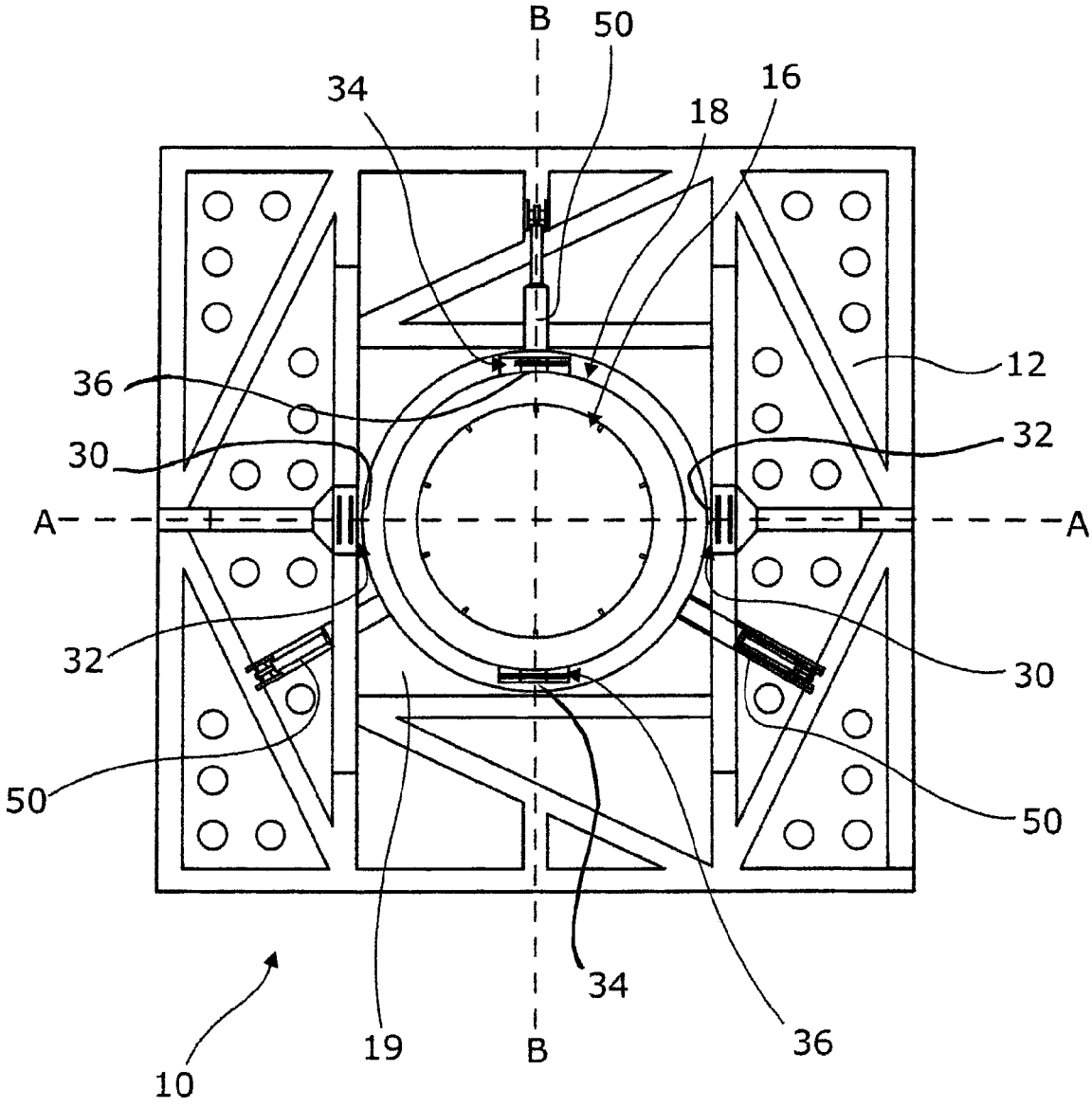
FIG. 2 is a plan view of the pile guide of FIG. 1.

FIG. 1 illustrates a pile guide 10 embodying the present invention. The pile guide 10 comprises a base frame 12 having a planar substrate-engaging surface 14, and a pile guide member 16 mounted on the base frame 12 via a support member 18. The pile guide member 16 is configured to guide a pile (not shown) in a predetermined direction relative to the base frame 12 as it is driven into a substrate 20, typically the sea bed, remote from surface of the sea and any service vessels. The predetermined direction is defined by the longitudinal axis of the cylindrical body 17 of the pile guide member 16, and intersects a central aperture 19 in the substrate-engaging surface 14 of the base frame 12. The support member 18 comprises first and second parts 30,32 which are pivotally coupled together to provide pivotal movement of the pile guide member 16 relative to the base frame 12 about a first axis of rotation AA. The support member 18 also comprises third and fourth parts 34,36 which are pivotally coupled together to provide pivotal movement of the pile guide member 16 relative to the base frame 12 about a second axis of rotation BB. In this way, the pile guide member 16 is able to move relative to the base frame 12 with two degrees of rotational freedom in the manner of a gimbal. As shown, axes AA and BB extend in a common plane, which is spaced from the substrate-engaging surface of the base frame and which lies parallel thereto.

Figure 3:
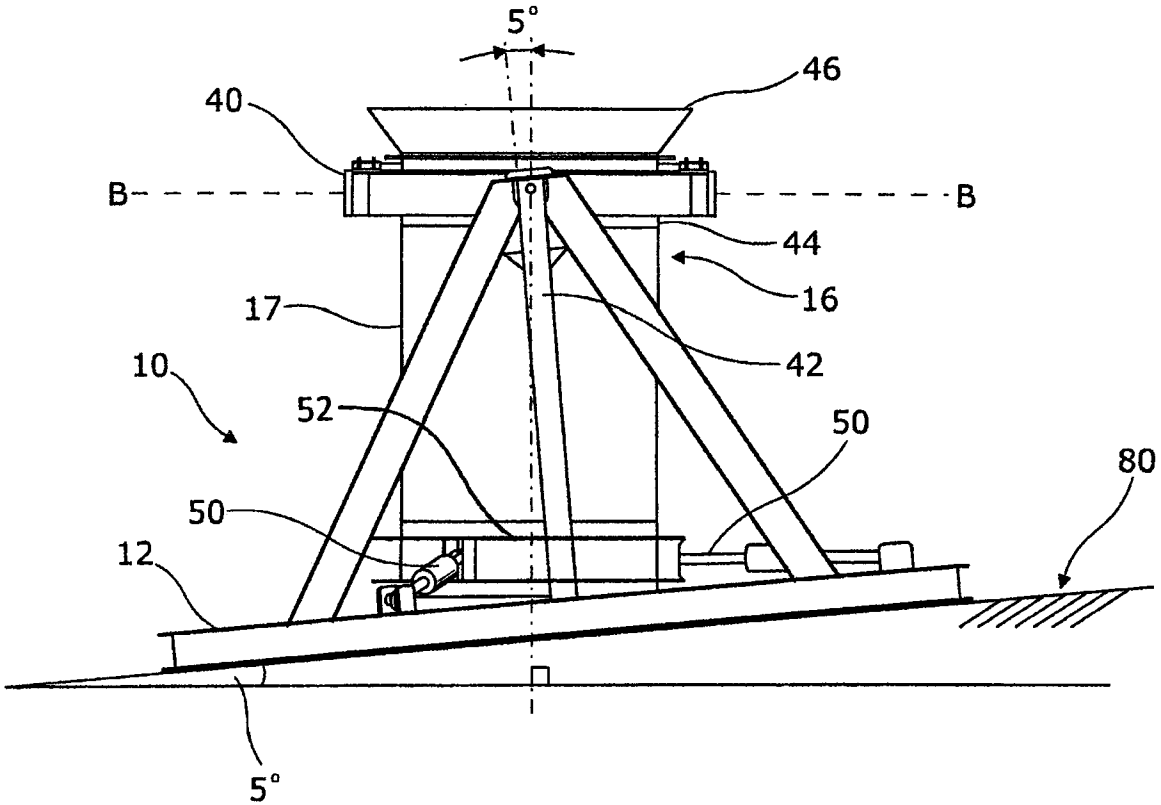
FIG. 3 is a front elevation of the pile guide of FIG. 1, with one part tilted relative to another part.
Figure 4:
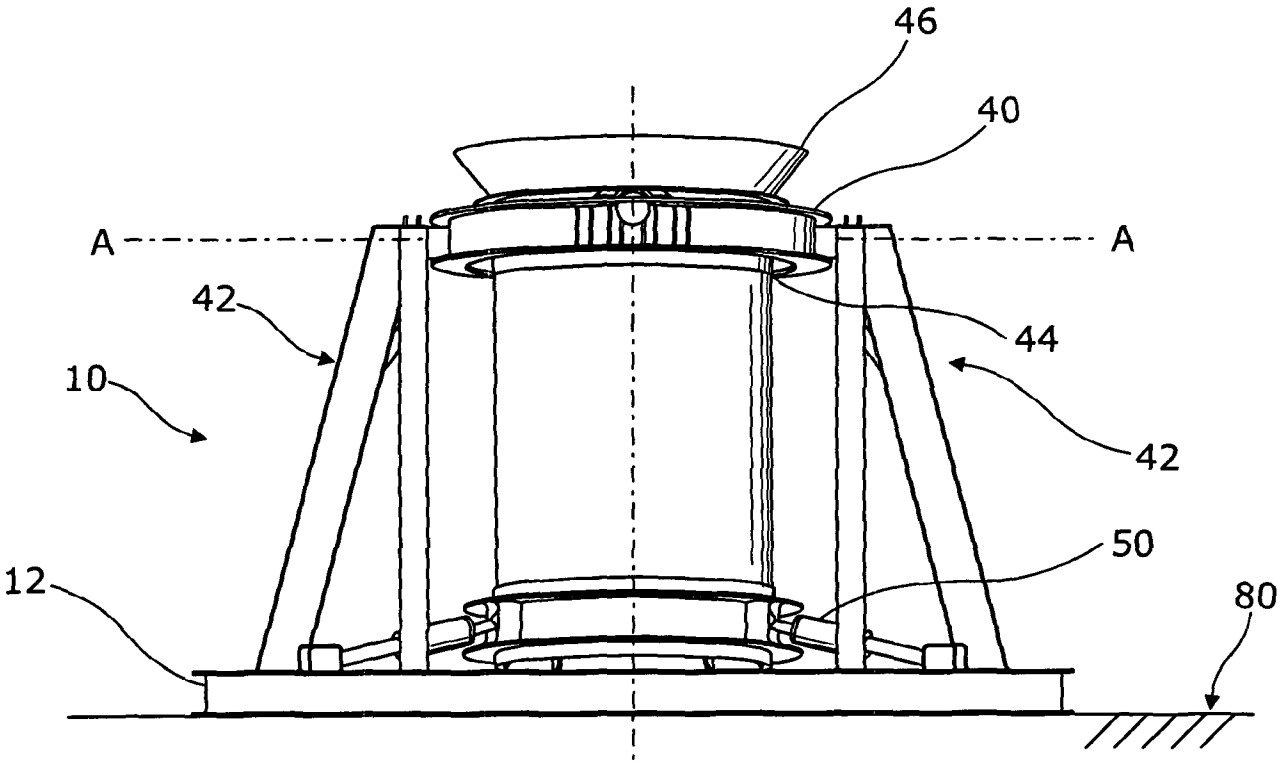
FIG. 4 is a side elevation of the pile guide of FIG. 1, with one part tilted relative to the other part.

The support member 18 includes an annular sleeve 40 and a pair of posts 42 extending upwardly from the base frame 12, with the annular sleeve 40 disposed between the posts 42. As shown in FIG. 3, the annular sleeve surrounds an upper portion 44 of the pile guide member 16, below its flared opening 46. The first part 30 is mounted on one of the posts 42 (thereby spacing it from the substrate-engaging surface), and the second part 32 is mounted on a radially outer periphery of the annular sleeve 40, facing the first part 30. (The same configuration is repeated for the other post 42, on a diametrically opposite side of the annular sleeve 40 to help balance the pivotal movement of the pile guide member 16). Each post is further braced relative to the base frame in a plane perpendicular to the first axis of rotation. The third part 34 is mounted on a radially inner periphery of the annular sleeve 40 and faces the fourth part 36 mounted on the pile guide member 16. (The same configuration is repeated on the diametrically opposite side of the annular sleeve 40 to help balance the pivotal movement of the pile guide member 16). The second part 32 and third part 36 are angularly offset by 90° so that the two axes of rotation AA and BB are perpendicular. The first and second parts 30,32 and the third and fourth parts 34,36 are each configured as a spindle and a corresponding socket in which the spindle is rotatably mounted.

The pile guide 10 includes three variable length struts 50, in the form of hydraulic rams, for controlling pivotal movement of the pile guide member 16 relative to the base frame 12. Each variable length strut 50 is pivotally mounted at one end to the base frame 12, and pivotally mounted at its other end to a lower portion 52 of the pile guide member 16 which is locally reinforced to prevent buckling. The three variable length struts 50 are circumferentially arranged evenly (i.e. at 120° intervals) around the longitudinal axis of the pile guide member 16, and are configured to operated in sympathy when tilting the pile guide member 16. For example, one variable length strut 50 may extend in length, whilst the other two may contract in length. Due to the fact that the pile guide member 16 has a centre of mass below the first and second pivot axes, the pile guide member 16 will adopt a vertical orientation under gravity when hydraulic pressure in the hydraulic rams is released, even if the planar substrate-engaging surface 14 of the base frame 12 is resting on an inclined substrate.

The pile guide 10 may be deployed at sea and come to rest on a seabed 80 inclined at an angle of at least 5° to the horizontal. (The angle of inclination is chosen merely by way of example and is in no way intended to be limiting.) In the arrangement of FIG. 3, the first axis of rotation is perpendicular to the page, and the second axis of rotation BB is in the plane of the page as indicated. Hydraulic pressure in the hydraulic rams/variable length struts 50 is released, allowing the pile guide member 16 to adopt a vertical orientation under gravity. Once the pile guide member 16 has assumed a vertical orientation, the hydraulic pressure may be applied to maintain the position of the pile guide member 16 relative to the base frame 12 during pile driving. Alternatively, the variable length strut 50 at the top of the incline is actively extended by increasing hydraulic pressure, and the pair of variable length struts 50 at the bottom of the incline are actively contracted by decreasing hydraulic pressure to drive pivotal movement of the pile guide member 16 about the first pivot axis AA, relative to the base frame 12. In this instance, there is no need to rotate the pile guide member 16 around the second pivot axis BB in order to restore the predetermined direction to the vertical.

In another form (not shown), the pile guide member may be configured in accordance with the teachings of WO 01/92645 (the entire contents of which are incorporated herein by reference). In other words, the pile guide member may comprise a pair of upright guide channels for receiving and guiding a pair of stabilizing fins associated with a finned pile during pile driving. In yet another form (not shown), the pile guide member may be configured in accordance with the teachings of WO 03/074795 (the entire contents of which are incorporated herein by reference). In other words, the pile guide member may comprise a pair of helical guide plates of opposite senses of rotation which define a tapering channel for correcting any angular misorientation of a pile with a corresponding profile which engages part of the helical guide plates when passing through the pile guide member. In still yet another form (not shown), the pile guide member may be configured in accordance with the teachings of WO 2007/066078 (the entire contents of which are incorporated herein by reference). In other words, the pile guide member may have in its periphery a slot which is configured to allow a laterally protruding coupling attached to a pile to pass along the slot as the pile passes through the pile guide member. The pile guide member has a pair of profiles which are engaged by corresponding profiles on the pile as the pile passes through the pile guide, with reaction forces between opposing profiles resisting gaping of the slot.

The invention claimed is:

1. A pile guide for supporting a pile as it is driven into a substrate, comprising:

a base frame having a substrate-engaging surface; and a pile guide member mounted on the base frame via a support member, the pile guide member being configured to guide therethrough in a predetermined direction a pile being driven into a substrate, the support member comprising first and second parts which are pivotally coupled together to permit pivotal movement of the pile guide member relative to the base frame about a first axis of rotation, wherein the support member further comprises third and fourth parts which are pivotally coupled together to permit pivotal movement of the pile guide member relative to the base frame about a second axis of rotation, enabling pivotal movement of the pile guide member relative to the base frame with two degrees of rotational freedom, and wherein one of the first and second parts and one of the third and fourth parts are rigidly coupled together by a continuous member extending around the pile guide member, with one of said first and second parts being disposed on an outer periphery of the continuous member and with one of said third and fourth parts being disposed on an inner periphery of the continuous member.

2. The pile guide according to claim 1, in which the pile guide member depends from the support member.

3. The pile guide according to claim 1, further comprising at least one mechanism for controlling pivotal movement of the pile guide member relative to the base frame about at least one of the first and second axes of rotation.

4. The pile guide according to claim 3, in which the at least one mechanism is mounted on the base frame and is coupled to a portion of the pile guide member below the support member.

5. The pile guide according to claim 3, in which the at least one mechanism comprises a variable length strut, pivotally coupled at one end to the base frame and pivotally coupled at an opposite end to the pile guide member.

6. The pile guide according to claim 3, in which there are a plurality of mechanisms for controlling pivotal movement of the pile guide member relative to the base frame, the plurality of mechanisms being configured to operate with one another when the pile guide member pivots relative to the base frame.

7. The pile guide according to claim 6, in which the plurality of mechanisms are circumferentially spaced evenly around the pile guide member.

8. The pile guide according to claim 3, in which the at least one mechanism for controlling pivotal movement of the pile guide member relative to the base frame is configured to retain the pile guide member in a chosen position relative to the base frame.

9. A method of driving a pile into a non-level substrate, comprising:

providing a pile guide comprising: a base frame having a substrate-engaging surface; and a pile guide member mounted on the base frame via a support member, the pile guide member being configured to guide therethrough in a predetermined direction a pile being driven into a substrate, the support member comprising: first and second parts which are pivotally coupled together to permit pivotal movement of the pile guide member relative to the base frame about a first axis of rotation; and third and fourth parts which are pivotally coupled together to permit pivotal movement of the pile guide member relative to the base frame about a second axis of rotation, enabling pivotal movement of the pile guide member relative to the base frame with two degrees of rotational freedom, wherein one of the first and second parts and one of the third and fourth parts are rigidly coupled together by a continuous member extending around the pile guide member, with one of said first and second parts being disposed on an outer periphery of the continuous member and with one of said third and fourth parts being disposed on an inner periphery of the continuous member;

positioning the pile guide with the substrate-engaging surface of the base frame resting on the non-level substrate;

tilting the pile guide member relative to the base frame until the predetermined direction of the pile guide member is aligned in a predetermined orientation; and driving the pile in the predetermined direction through the pile guide member and into the non-level substrate.

10. A pile guide for supporting a pile as it is driven into a substrate, comprising:

a base frame having a substrate-engaging surface; and a pile guide member mounted on the base frame via a support member, the pile guide member being configured to guide therethrough in a predetermined direction a pile being driven into a substrate, the support member comprising first and second parts which are pivotally coupled together to permit pivotal movement of the pile guide member relative to the base frame about a first axis of rotation, wherein the support member further comprises third and fourth parts, which are supported by the first and second parts such that the third and fourth parts are pivotable with the pile guide member about the first pivot axis, and which are pivotally coupled together to permit pivotal movement of the pile guide member relative to the base frame about a second axis of rotation, enabling pivotal movement of the pile guide member relative to the base frame with two degrees of rotational freedom.

11. The pile guide according to claim 10, in which the pile guide member depends from the support member.

12. The pile guide according to claim 10, further comprising at least one mechanism for controlling pivotal movement of the pile guide member relative to the base frame about at least one of the first and second axes of rotation.

13. The pile guide according to claim 12, in which the at least one mechanism is mounted on the base frame and is coupled to a portion of the pile guide member below the support member.

14. The pile guide according to claim 12, in which the at least one mechanism comprises a variable length strut, pivotally coupled at one end to the base frame and pivotally coupled at an opposite end to the pile guide member.

15. The pile guide according to claim 12, in which there are a plurality of mechanisms for controlling pivotal movement of the pile guide member relative to the base frame, the plurality of mechanisms being configured to operate with one another when the pile guide member pivots relative to the base frame.

16. The pile guide according to claim 15, in which the plurality of mechanisms are circumferentially spaced evenly around the pile guide member.

17. The pile guide according to claim 12, in which the at least one mechanism for controlling pivotal movement of the pile guide member relative to the base frame is configured to retain the pile guide member in a chosen position relative to the base frame.

* * * * *